US010186185B2

(12) United States Patent
Cameron

(10) Patent No.: US 10,186,185 B2
(45) **Date of Patent: *Jan. 22, 2019**

(54) DYNAMICALLY ADJUSTING COLOR CHARACTERISTICS OF ELECTRONIC CONTENT

(71) Applicant: Adobe Systems Incorporated, San Jose, CA (US)

(72) Inventor: Stefan P. Cameron, Mountian View, CA (US)

(73) Assignee: Adobe Systems Incorporated, San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/059,577

(22) Filed: Mar. 3, 2016

(65) Prior Publication Data

US 2016/0189594 A1 Jun. 30, 2016

Related U.S. Application Data

(63) Continuation of application No. 13/194,878, filed on Jul. 29, 2011, now Pat. No. 9,330,629.

(51) Int. Cl.
*G09G 3/20* (2006.01)
*G09G 5/02* (2006.01)

(52) U.S. Cl.
CPC ..... *G09G 3/2003* (2013.01); *G09G 5/02* (2013.01); *G09G 5/026* (2013.01); *G09G 2320/0242* (2013.01); *G09G 2320/0666* (2013.01)

(58) Field of Classification Search
CPC ... G09G 2320/0242; G09G 5/02; G09G 5/026
See application file for complete search history.

(56) References Cited

U.S. PATENT DOCUMENTS

| | | | | |
|---|---|---|---|---|
| 5,381,349 | A | 1/1995 | Winter et al. | |
| 7,092,008 | B1 | 8/2006 | Bernard et al. | |
| 9,330,629 | B2 * | 5/2016 | Cameron | G09G 5/02 |
| 2002/0161803 | A1 | 10/2002 | Shelton | |
| 2010/0214421 | A1 | 8/2010 | Qu et al. | |
| 2010/0290066 | A1 * | 11/2010 | Son | H04N 1/6011 358/1.9 |
| 2011/0084989 | A1 | 4/2011 | Kim et al. | |
| 2012/0127324 | A1 * | 5/2012 | Dickins | G09G 3/006 348/191 |

OTHER PUBLICATIONS http://www.nikonusa.com/Learn-And-Explore/Nikon-Camera-Technology/ftlzi4gl/l/Auto-White-Balance.html, one page, 2001.

* cited by examiner

*Primary Examiner* — Kyle Zhai
(74) *Attorney, Agent, or Firm* — Kilpatrick Townsend & Stockton LLP

(57) ABSTRACT

Exemplary embodiments involve a viewer application dynamically adjusting the color balance of electronic content displayed on a display device. A viewer application can determine color information for a display device and generate a color correction filter based on color information for the display device and color information used by electronic content to specify the test color. The viewer application can receive display data representing at least a portion of the electronic content and apply the color correction filter to the display data to provide a color-corrected version of the display data for display by the display device. The viewer application can obtain the color information from a device driver application for the display device or from a separate data file.

20 Claims, 4 Drawing Sheets

DYNAMICALLY ADJUSTING COLOR CHARACTERISTICS OF ELECTRONIC CONTENT

CROSS-REFERENCE TO RELATED APPLICATIONS

This application is a continuation application of application Ser. No. 13/194,878, filed Jul. 29, 2011, now allowed, which is incorporated herein by reference in its entirety.

TECHNICAL FIELD

This disclosure relates generally to computer software and more particularly relates to dynamically adjusting color characteristics of electronic content for display.

BACKGROUND

The appearance of electronic content, such as web pages, displayed on display devices, such as the monitor of a desktop computer, can change based on the color-balancing scheme of each display device. The color balance of each device can include the relative intensity of each of the primary colors (typically red, green, and blue colors) that a display device combines to display other colors. The color balancing scheme of display devices can vary from one device type to another (e.g., a CRT monitor versus an LCD screen) as well as from one manufacturer to another. Differences in color balancing schemes among different display devices can cause colors in electronic content to be displayed with undesirable hues, such as a gray color appearing pink when displayed on a monitor with a reddish hue, with under-saturated colors (e.g., with a darker appearance than desired), or with over-saturated colors (e.g., with a brighter appearance than desired).

The display settings of a particular display device can be modified such that the colors of a particular electronic content item are displayed as intended. For example, a computer monitor that applies a reddish hue to all objects can be manually adjusted to reduce the intensity of the red light source used to illuminate the pixels of the display, thereby diminishing the reddish hue and improving the display of a particular electronic content item. Having to manually adjust the display settings of a particular display device for different items of electronic content being displayed has required end user knowledge of display setting adjustment capabilities and end user time and effort.

SUMMARY

Systems and methods for dynamically adjusting the color balance of electronic content displayed on a display device are disclosed. An exemplary embodiment involves a viewer application determining color information for a display device. The color information includes intensities of primary colors that result in the display of a test color when used to specify a color on the display device. The viewer application generates a color correction filter based on the color information for the display device and color information used by electronic content to specify the test color. The color correction filter includes a correction factor for intensity of each of the primary colors. The viewer application receives display data representing at least a portion of the electronic content and applies the color correction filter to the display data. The viewer application provides a color-corrected version of the display data for display by the display device.

These illustrative features are mentioned not to limit or define the disclosure, but to provide examples to aid understanding thereof. Additional embodiments are discussed in the Detailed Description, and further description is provided there. Advantages offered by one or more of the various embodiments may be further understood by examining this specification or by practicing one or more embodiments presented.

BRIEF DESCRIPTION OF THE FIGURES

The patent or application file contains at least one drawing executed in color. Copies of this patent or patent application publication with color drawing(s) will be provided by the Office upon request and payment of the necessary fee.

These and other features, aspects, and advantages of the present disclosure are better understood when the following Detailed Description is read with reference to the accompanying drawings, where.

DETAILED DESCRIPTION

Figure 1:
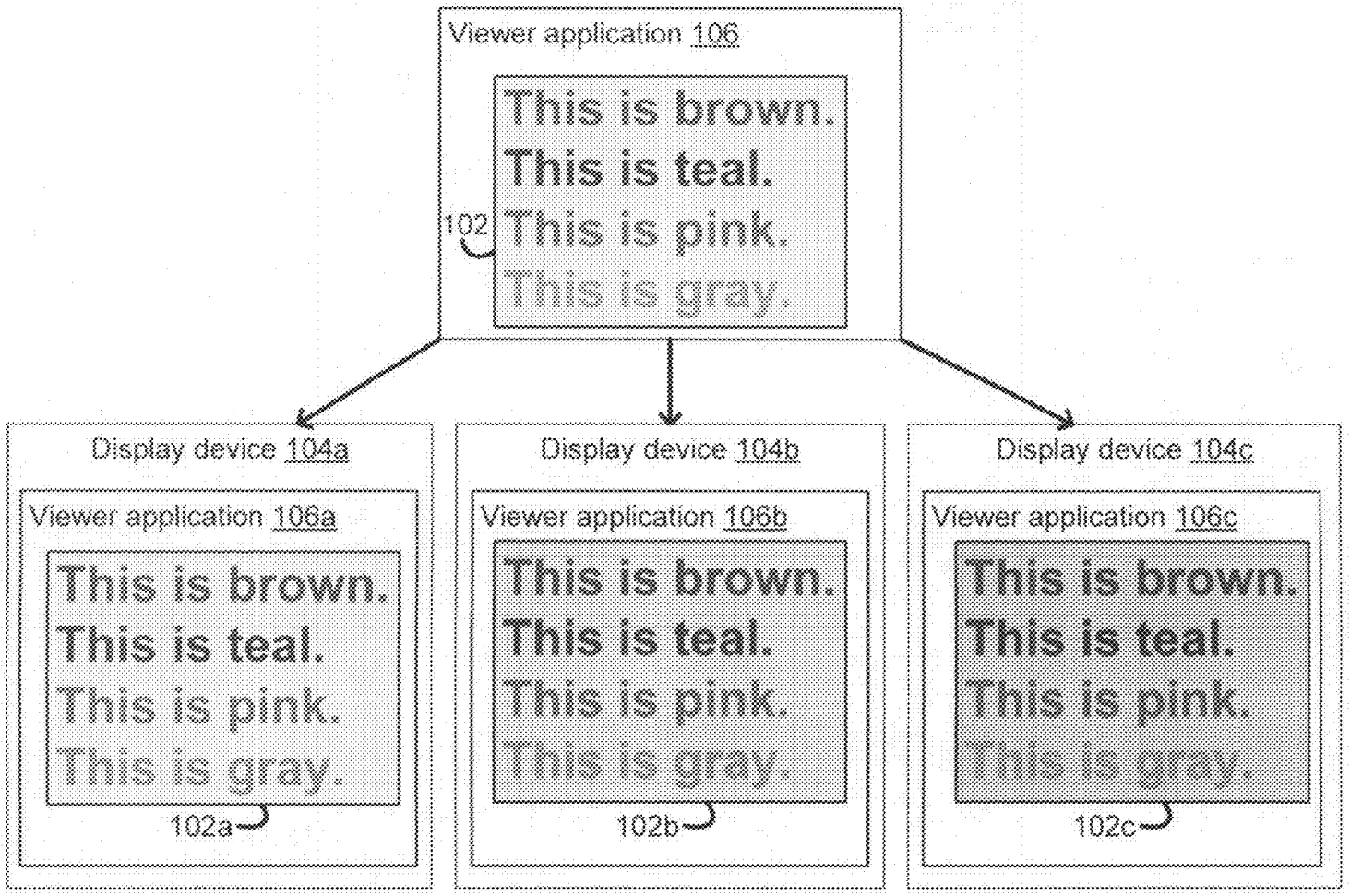
FIG. 1 is a modeling diagram illustrating how electronic content is displayed differently on different display devices without dynamically adjusting the color balance of electronic content.

Systems and methods are provided that dynamically adjust the color balance of electronic content displayed on different display devices. Dynamically adjusting the color balance of electronic content can provide various advantages, such as improving the color fidelity of electronic content regardless of the display device on which the electronic content is displayed and/or ensuring a consistent color appearance of the electronic content on devices of different types, brands, and models.

A viewer application executed by a processor can determine the color information for a display device. The color information can include intensities of primary colors that result in the display of a test color when used to specify a color on the display device. The viewer application can generate a color correction filter based on the color information for the display device and color information used by electronic content to specify the test color. The color correction filter can include a correction factor for the intensity of each of the primary colors. The viewer application can receive display data representing at least a portion of the electronic content, apply the color correction filter to display data, and provide a color-corrected version of the display data for display by the display device.

The viewer application can adjust the color balance and thereby improve the color fidelity for electronic content as displayed on a display device. By applying a color correction filter to the display data after receiving the data of the electronic content and before providing the data to the display device, the viewer application can improve the color fidelity of the electronic content as displayed by a display device. Furthermore, improving color fidelity using the viewer application does not necessarily require modifying the electronic content to customize its display on a particular display device or modifying the display settings of a display device to customize how the display device displays particular electronic content.

As used herein, the term "viewer application" is used to refer to any application that receives and executes or interprets electronic content items and provides display data for displaying the electronic content of such items at a display device. Examples of a viewer application include, but are not limited to, an image viewer, an Internet browser, a rich Internet application, or a desktop application. An image viewer can be an application that can render graphical images for display. Examples of image viewers can include Microsoft® Windows® Photo Viewer, Adobe® Image Viewer, or Google® Picasa. An Internet browser can be an application for retrieving, presenting, and traversing information resources available on the World Wide Web. A rich Internet application can be a web-based application with functionality equivalent to a desktop application. Examples of such functionality include, but are not limited to, features such as context menus, keyboard shortcuts, rich text editors, etc. Examples of rich Internet applications include Adobe® Flash® applications, Microsoft® Outlook® Web Access, Google® Docs®, etc.

As used herein, the term "electronic content" is used to refer to any type of media that can be displayed on a display device of a computing system or other electronic device. Electronic content can include text or multimedia files, such as images and video. Electronic content can also include application software that is designed to perform one or more specific tasks at a computing system.

As used herein, the term "color balance adjustment" is used to refer to the adjustment of the color information for colors used to display the electronic content.

As used herein, the term "color intensity" is used to refer to the strength of a color. Increasing the intensity of a color can cause the color to appear lighter. Decreasing the intensity of a color can cause the color to appear darker.

As used herein, the term "color information" is used to refer to a group of colors and their respective intensities that can be combined to produce various colors in electronic content. The colors used to display the electronic content can include, but are not limited to, the primary colors red, green, and blue. Color information can include, but is not limited to, the red, green, and blue (RGB) values used to specify a color (i.e., the respective intensities of red, green, and blue that, when combined, display the color). For example, a display device can generate a color using a red light source, a green light source, and a blue light source, to illuminate a pixel on the screen of the display device. Varying the intensity of each of the RGB light sources can change the color of the pixel displayed on the screen. Accordingly, a given color can be represented by the color information specifying the intensity of each RGB light source. For example, a purple color can have RGB values (R=110, G=46, B=230), with the numerals identifying intensity values for each of red, green and blue, respectively. The purple color can be changed to a pink color by increasing the intensity of the red color such that the new RGB values are (R=255, G=46, B=230).

In an exemplary embodiment, determining color information specifying a test color can include determining the color information used to display a perfect white color. An RGB value for perfect white can be (R=255, G=255, B=255). Determining the color information used to display perfect white can include determining the RGB values displayed by the display device when the electronic content requests "perfect white."

Generating the color correction filter can include determining correction factors for each of the primary colors in the color information. To determine the correction factors, the viewer application can determine an intensity of each primary color of the color information for the display device and an intensity of each primary color of the color information used by the electronic content. For example, if the test color is perfect white, the color information for the display device can be the RGB values (R=255, G=240, B=240) and the color information used by the electronic content can be the RGB values (R=255, G=255, B=255). The viewer application can then determine a correction factor for each primary color. A correction factor can be a ratio of the intensity of each primary color of the color information used by the electronic content to the intensity of each primary color of the color information for the display device. For example, if electronic content uses RGB values (R=255, G=255, B=255) for perfect white and a display device uses RGB values (R=255, G=240, B=240) for perfect white, the respective correction factors in the color correction filter are 255/255 for red values, 255/240 for green values, and 255/240 for blue values.

Applying the color correction filter to the display data can include multiplying the color information for each color in the electronic content to be displayed by the correction factor specified by the color correction filter. For example, a color correction filter may be (R: 255/255, G: 255/240, B: 255/240) and a color in the electronic content may have RGB values (R=128, G=128, B=128). After applying the color correction filter to the display data, the color would be specified using the RGB values (R=128, G=136, B=136) (i.e., (R=128×255/255, G=128×255/240, B=128×255/240)). When the color-corrected version of the display data is "distorted" by the display device, the resulting color displayed by the display device can approximate the proper color for the electronic content.

The following example illustrates how a viewer application can dynamically adjust the color balance of electronic content for display on a display device. A viewer application, such as an Internet browser, can be used to execute or otherwise use electronic content, such as a web page. The web page can be viewed on a display device, such as a monitor for a desktop computer. The display device, however, may use different color information to display colors that gives colors a pink hue. For example, instead of the display device using RGB values (R=255, G=255, B=255) to display the color white, the display device may use RGB values (R=255, G=240, B=240). The Internet browser can reduce the pink hue by adjusting the RGB values of colors from the web page with a correction factor to compensate for the color-balancing scheme causing the pink hue before providing the color to the display device.

Determining the color information for the display device to display a test color can include the viewer application requesting the color information from a device driver application configured to control the display device. As used herein, the term "device driver application" is used to refer to a software module providing an interface between an application and a hardware device. A device driver application can receive input from another application and configure the device to perform an action in response to the input. For example, instead of a viewer application directly communicating with a display device, the viewer application can send a request to the device driver application associated with a display device to render electronic content. The device driver application can communicate with a device directly or can send requests to an operating system for a computing device. The viewer application can communicate with the device driver application associated with a display device to determine the color information that device driver application uses to configure the display device to display a given color.

Determining the color information for the display device to display a test color can additionally or alternatively include the viewer application referencing a data file containing information about how a particular type of display device displays colors. The viewer application can determine a device type for the display device by, for example, requesting that the device driver application identify the device type for the display device. The viewer application can access a data file comprising color information for the device type and retrieve the color information for the device type from the data file. The data file can include information about the color information for various types of display devices. The data file can be stored in memory or accessed via a network.

These illustrative examples are given to introduce the reader to the general subject matter discussed here and are not intended to limit the scope of the disclosed concepts. The following sections describe various additional embodiments and examples with reference to the drawings in which like numerals indicate like elements.

The features discussed herein are not limited to any particular hardware architecture or configuration. A computing device can include any suitable arrangement of components that provide a result conditioned on one or more inputs. Suitable computing devices include multipurpose microprocessor-based computer systems accessing stored software that programs or configures the computing system from a general purpose computing apparatus to a specialized computing apparatus implementing one or more embodiments of the present subject matter. Any suitable programming, scripting, or other type of language or combinations of languages may be used to implement the teachings contained herein in software to be used in programming or configuring a computing device.

Referring now to the drawings, FIG. 1 is a modeling diagram illustrating how electronic content 102 is displayed differently on different display devices 104*a-c* without dynamically adjusting the color balance of the electronic content.

The exemplary electronic content 102 is displayed on the display devices 104*a-c* using instances 106*a-c* of a viewer application 106. The display devices 104*a-c* can be display devices for different computing devices. For example, display device 104*a* can be a tablet computer, display device 104*b* can be a smart phone, and display device 104*c* can be a laptop computer. Display devices 104*a-c* can also be different types of display devices for a common computing system. For example, display devices 104*a-c* can be different display devices for a desktop computer, where display device 104*a* is a cathode ray tube (CRT) monitor, display device 104*b* is a liquid crystal display (LCD) monitor, and display device 104*c* is a plasma display monitor. Display devices 104*a-c* can also be different models or brands of a common type of monitor (e.g., LCD monitors from different manufacturers).

Electronic content can include color information specifying how to display each of the colors used in the electronic content. For example, the electronic content 102 is depicted as including brown, teal, pink, and gray text against a yellow background. The electronic content 102 can include color information specifying that the brown text is displayed using, for example, RGB values (R=153, G=51, B=0). The electronic content 102 can include color information specifying that the teal text is displayed using, for example, RGB values (R=0, G=128, B=128). The electronic content 102 can include color information specifying that the pink text is displayed using, for example, RGB values (R=255, G=51, B=153). The electronic content 102 can include color information specifying that the gray text is displayed, for example, using RGB values (R=153, G=153, B=153). The electronic content 102 can include color information specifying that the yellow background for the text is displayed, for example, using RGB values (R=255, G=255, B=153).

As depicted in FIG. 1, none of the viewer applications 106*a-c* have adjusted the color balance of the electronic content 102 with respect to the displace devices 104*a-c*. The same electronic content 102 is therefore depicted as being displayed with different color fidelity on the different display devices 104*a-c*. Color fidelity can be the degree to which a color included in the electronic content 102 is displayed as intended on a display device. If the color information for the display device to display a color matches the color information used by the electronic content to specify the color, the display device is displaying the electronic content 102 with full color fidelity.

For example, the display device 104*a* displays electronic content 102*a* with full color fidelity such that the RGB values used by the display device 104*a* are equal to the RGB values used by the electronic content 102. The brown text is displayed using RGB values (R=153, G=51, B=0), the teal text is displayed using RGB values (R=0, G=128, B=128), the pink text is displayed using RGB values (R=255, G=51, B=153), the gray text is displayed using RGB values (R=153, G=153, B=153), and the yellow background is displayed using RGB values (R=255, G=255, B=153).

The display device 104*b*, however, distorts the colors of electronic content 102 such that electronic content 102*b* is displayed with reduced color fidelity. The electronic content 102*b* is rendered for display on the display device 104*b* such that the brown text is displayed using RGB values (R=132, G=44, B=0), the teal text is displayed using RGB values (R=0, G=106, B=128), the pink text is displayed using RGB values (R=220, G=44, B=153), the gray text is displayed using RGB values (R=132, G=132, B=153), and the yellow background is displayed using RGB values (R=220, G=220, B=153). The various colors of the electronic content 102 appear under-saturated, or darker, in the electronic content 102*b* as compared to the electronic content 102*a*.

The display device 104*c* renders the colors of electronic content 102 for display such that electronic content 102*c* is displayed with even further reduced color fidelity. The electronic content 102*c* is rendered for display on the display device 104*b* such that the brown text is displayed using RGB values (R=126, G=38, B=0), the teal text is displayed using RGB values (R=0, G=95, B=105), the pink text is displayed using RGB values (R=210, G=38, B=126), the gray text is displayed using RGB values (R=126, G=114, B=126), and the yellow background is displayed using RGB values (R=210, G=190, B=126). The saturation of the colors red, green, blue, and gray in the electronic content 102*c* is decreased by the display device 104*c* to such a degree that the respective colors become difficult to distinguish from one another.

Figure 2:
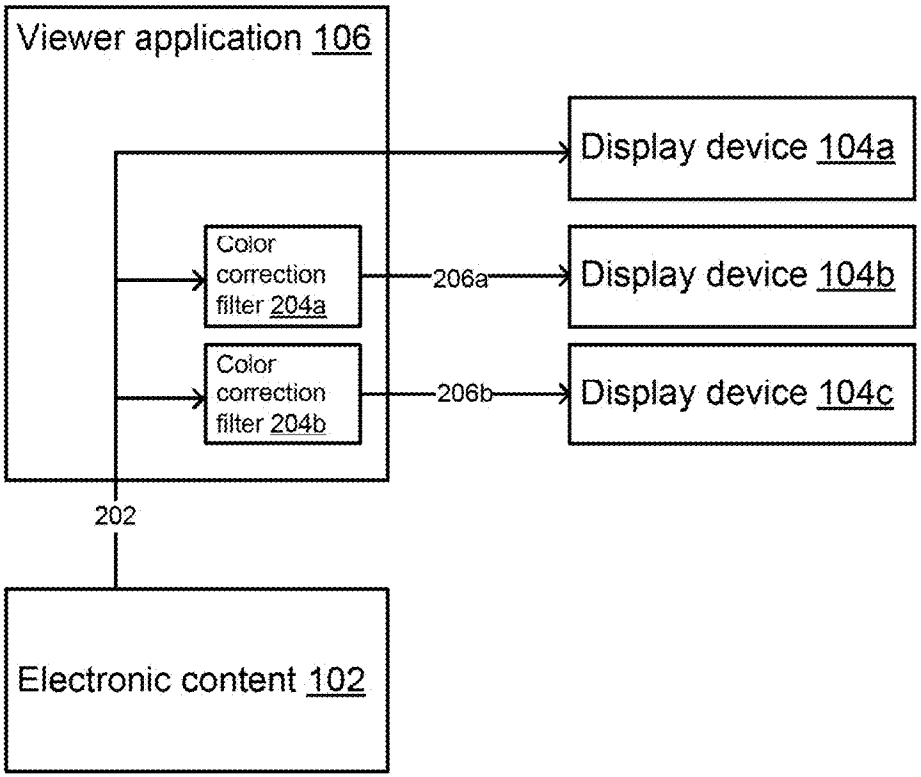
FIG. 2 is a modeling diagram illustrating an exemplary flow of communications between a viewer application dynamically adjusting the color balance of the electronic content and multiple display devices.

The viewer application 106 can be used to compensate for the distortion of the electronic content 102 by the display devices 104*b*, 104*c* depicted in FIG. 1. FIG. 2 is a modeling diagram illustrating an exemplary flow of communications between a viewer application 106 dynamically adjusting the color balance of the electronic content 102 and multiple display devices 104*b*, 104*c*. The viewer application 106 can access display data 202 from electronic content 102. The display data 202 can represent a portion of the electronic content 102 to be displayed at display devices 104*b*, 104*c*. For example, if electronic content 102 is a web site displayed using a viewer application 106 that is an Internet browser, display data 202 can include a particular web page from the web site and a cascading style sheet (CSS) specifying the formatting of the web page.

The viewer application 106 can apply color correction filters 204*a*, 204*b* to the display data 202. The color correction filters 204*a*, 204*b* can modify the display data 202 to compensate for the reduced color fidelity of the display devices 104*b*, 104*c* respectively. The color correction filter 204*a* can be customized to the display device 104*b*. The color correction filter 204*b* can be customized to the display device 104*c*. The color correction filters 204*a*, 204*b* can modify the display data 202 to compensate for the distortion of the respective display devices 104*b*, 104*c*.

The viewer application can provide data 206*a*, 206*b* to the display devices 104*b*, 104*c* respectively. The data 206*a* represents the display data 202 from the electronic content 102 modified by the color correction filter 204*a*. The data 206*b* represents the display data 202 from the electronic content 102 modified by the color correction filter 204*b*. When the display devices 104*b*, 104*c* display the data 206*a*, 206*b* representing color-corrected versions of the display data 202, the display devices 104*b*, 104*c* can display the electronic content with increased color fidelity.

The viewer application 106 can also provide the display data 202 directly to the display device 104*a*. The display device 104*a* can be a display device that can display the electronic content 102 with full color fidelity. Accordingly, the viewer application 106 can provide the display data 202 to the display device 104*a* without applying a color correction filter.

Figure 3:
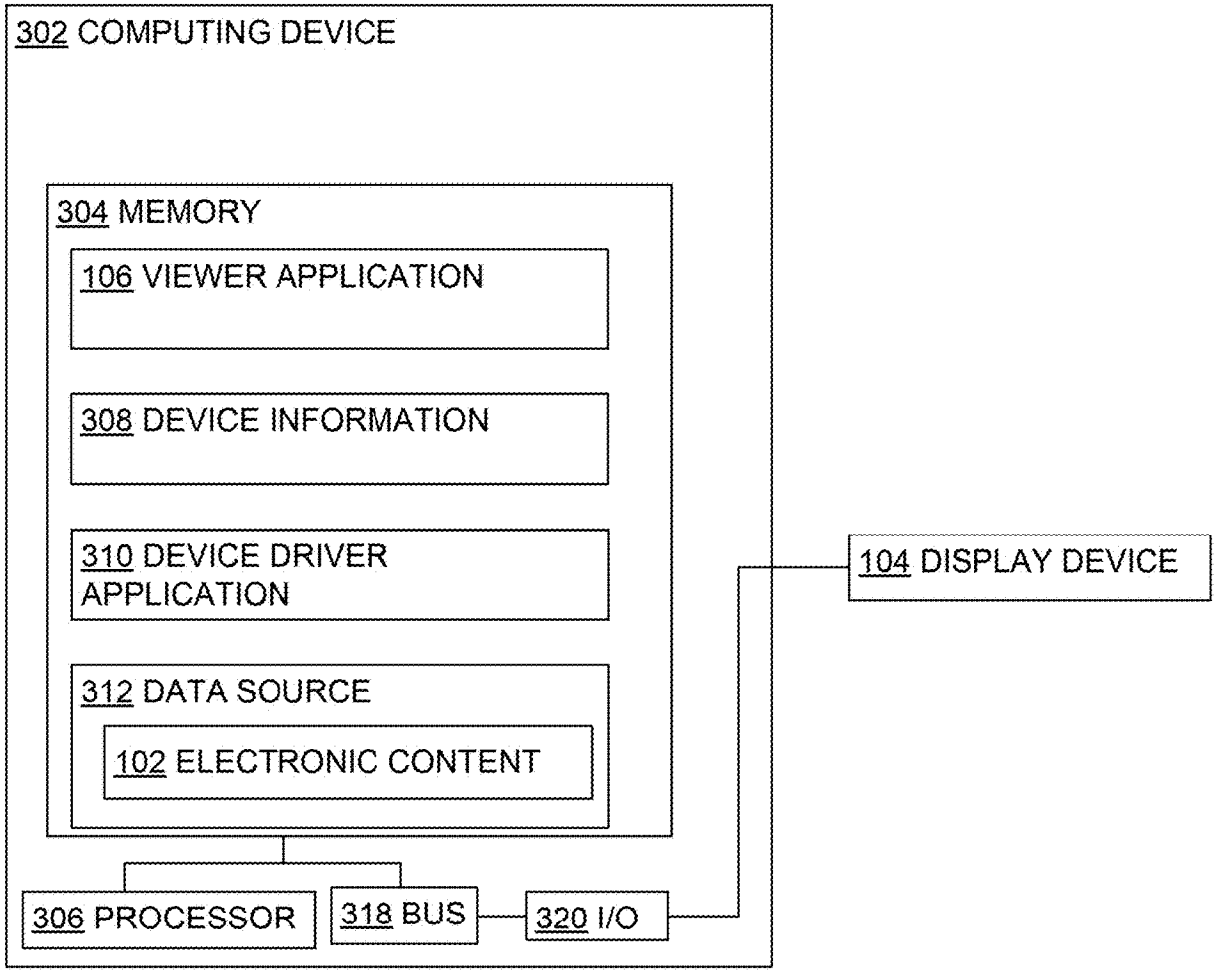
FIG. 3 is a block diagram depicting exemplary computing devices in an exemplary computing environment for implementing certain embodiments.

FIG. 3 is a block diagram depicting exemplary computing devices in an exemplary computing environment for implementing certain embodiments. Electronic content 102 executes or is otherwise used on the exemplary computing device 302 and is shown using functional components or modules. As is known to one of skill in the art, such electronic content may be resident in any suitable non-transitory computer-readable medium and can be executed on any suitable processor.

For example, as shown, an exemplary computing device 302 can include a non-transitory computer-readable medium, such as a random access memory (RAM) 304, coupled to a processor 306 that executes computer-executable program instructions and/or accesses information stored in a memory 304. Such a processor 306 may include a microprocessor, an application-specific integrated circuit (ASIC), a state machine, or other processor, and can be any of a number of computer processors. Such a processor can include, or may be in communication with, a non-transitory computer-readable medium which stores instructions that, when executed by the processor 306, cause the processor 306 to perform the steps described herein.

A non-transitory computer-readable medium may include, but is not limited to, an electronic, optical, magnetic, or other storage device capable of providing a processor with computer-readable instructions. Other examples include, but are not limited to, a floppy disk, CD-ROM, DVD, magnetic disk, memory chip, ROM, RAM, an ASIC, a configured processor, optical storage, magnetic tape or other magnetic storage, or any other medium from which a computer processor can read instructions. The instructions may comprise processor-specific instructions generated by a compiler and/or an interpreter from code written in any suitable computer-programming language, including, for example, C, C++, C#, Visual Basic, Java, Python, Perl, JavaScript, and ActionScript.

The computing device 302 can receive input and provide output via input/output (I/O) interface 320. Computing device 302 can provide data for display to a display device 104 via I/O interface 320. A bus, such as bus 318, is included in the computing device 302. Computing device 302 can be any type of computing system included in a network at a domain appropriate for providing one or more of the features described herein.

FIG. 3 illustrates an exemplary computing device 302 that includes, in a memory 304, a viewer application 106 and electronic content 102. The viewer application 106 can configure the processor 306 to retrieve electronic content 102 from a data source 312, load the electronic content 102 into the memory 304, and provide data representing the electronic content 102 to the display device 104 via I/O interface 320. The electronic content 102 can include, but is not limited to, video files, audio files, image files, etc. A data source 312 can be any source of data that provides data upon request, pushed data, or otherwise provides data items for use by other applications. In alternative embodiments, the data source 312 may be disposed in the computing device 302 or may be provided from an external location, such as a server accessed via a network.

The memory 304 can also include device information 308 and/or device driver application 310. Device information 308 can be a data file including color information for several different types of display devices. The device information 308 can include the color information for various types of display devices. In alternative embodiments, the device information 308 can be stored in memory 304 or accessed via a network. The viewer application can reference the device information 308 to determine the color information for the display device 104 if the device type for display device 104 is included in the device information 308.

The device driver application 310 can provide an interface between the viewer application 106 and a display device 104. The device driver application 310 can receive input from the viewer application 106. The input from the viewer application 106 can include display data representing at least a portion of the electronic content 102 and instructions for the display device 104 to display the display data. Instead of the viewer application 106 directly communicating with the display device 104, the viewer application 106 can send a request to the device driver application 310 to display the display data. The device driver application 310 can communicate with the display device 104 directly or via the operating system of the computing device 302. The device driver application 310 can also provide the color information for the display device 104 to the viewer application 106.

Figure 4:
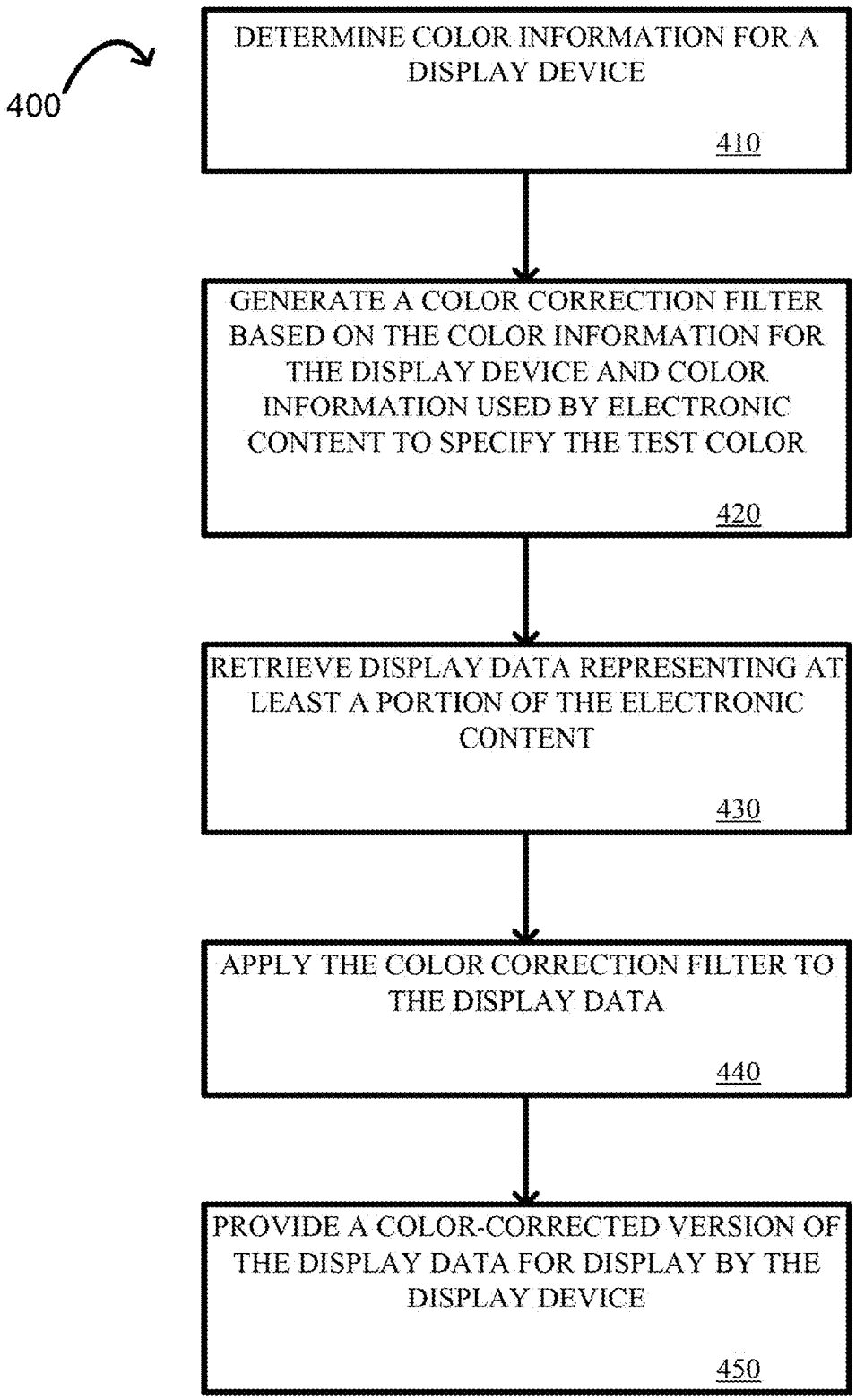
FIG. 4 is a flow chart illustrating an exemplary method for dynamically adjusting the color balance of electronic content displayed on different display devices.

FIG. 4 is a flow chart illustrating an exemplary method 400 for dynamically adjusting the color balance of electronic content displayed on different display devices. For illustrative purposes, the exemplary method 400 is described with reference to the elements of the flow of communications depicted in FIG. 2 and the system implementation depicted in FIG. 3. Other implementations, however, are possible.

The exemplary method 400 involves determining color information for a display device 104, as shown in block 410. The viewer application 106 can determine the color information. The color information for the display device 104 can include the intensities of primary colors that can be combined to display a test color when used to specify a color on the display device 104.

In an exemplary embodiment, determining the color information specifying a test color can include determining the color information used to display "perfect white." The color information used to display perfect white can include the primary colors and their respective intensities used by the device driver application 310 to configure the display device 104 to display a perfect white color. For example, display devices may use the RGB values (R=255, G=255, B=255) to display perfect white. A particular device driver application 310, however, may adjust the color information for perfect white. For example, a device driver application 310 may use the RGB values (R=255, G=240, B=240) when configuring a display device 104 to display perfect white.

In one embodiment, determining the color information for the display device 104 can include the viewer application 106 requesting the color information from the device driver application 310. For example, the viewer application 106 can communicate with the device driver application 310 to determine the color information, such as the RGB values, that the device driver application 310 uses to configure the display device 104 to display the test color.

In another embodiment, determining the color information for the display device 104 can include the viewer application 106 referencing the device information 308. The viewer application 106 can determine a device type for the display device 104 by requesting that the device driver application 310 identify the device type. The viewer application 106 can then access the device information 308 to determine the color information used to display the test color on the identified type of display device.

In additional or alternative embodiments, the viewer application 106 can first reference the device information 308 to determine the color information for the display device 104. If the device information 308 does not include the device type for the display device 104, the viewer application 106 can request the color information from the device driver application 310. Upon receiving the color information from the device driver application 310, the viewer application 106 can update the device information 308 to include the color information for the device type corresponding to the display device 104.

The exemplary method 400 further involves generating a color correction filter 204 based on the color information for the display device 104 and color information used by electronic content 102 to specify the test color, as shown in block 420. The viewer application 106 can generate a color correction filter 204 that is customized for the display device. The color correction filter can include correction factors for adjusting the intensity of each primary color of the color information used by the electronic content 102.

The correction factors included in the color correction filter 204 can be used to compensate for the differences between the electronic content 102 and the display device 104 with respect to the intensity of each primary color. To determine the correction factors, the viewer application 106 can determine how the color information used by the electronic content 102 is modified to yield the color information for the display device 104. The viewer application 106 can select a correction factor that can be used to adjust the intensity of each primary color of the color information used by the electronic content 102. Adjusting the color information for a given color using the color correction filter can compensate for the modification of the color information used by the electronic content 102 when a color is displayed by the display device 104.

In an exemplary embodiment, the electronic content 102 can use color information specifying a perfect white color to generate a color correction filter. The viewer application 106 can determine a color correction filter using a perfect white color with RGB values (R=255, G=255, B=255) for the test color used by the electronic content 102 and the corresponding RGB values used by the display device 104 to display the perfect white test color. The correction factor can be ratio of the color intensities in the color information used by electronic content 102 to the corresponding color intensities in the color information for the display device 104. For example, the display device 104 may use RGB values (R=255, G=240, B=240) to display the test color perfect white. The display device 104 would distort other colors proportionately. If, for example, electronic content was developed using a display device displaying teal as (R=0, G=128, B=128), the display device 104 would display teal using RGB values (R=0×255/255=0, G=128×240/255=120, B=128 240/255=120). A color correction filter 204 can therefore include the ratios (R: 255/255; G: 255/240; B: 255/240) for the respective red, green, and blue values.

The exemplary method 400 further involves receiving display data 202 representing at least a portion of the electronic content 102, as shown in block 430. The viewer application 106 can receive the display data 202 from the electronic content 102. The viewer application 106 can modify the display data 202 using the color correction filter 204. The viewer application can thereby dynamically adjust the color balance of the electronic content 102 as displayed on a particular display device 104 without modifying the electronic content 102 or modifying the device settings of the display device 104.

For example, if electronic content 102 is a web page and a viewer application 106 is an Internet browser, the electronic content 102 can include a CSS specifying the formatting of the web page. The Internet browser can receive display data 202 that is a copy of the CSS including the color information for the web page. The viewer application can use the copy of the CSS to adjust the color balance of the web page for a particular display device rather than modifying the CSS used to display the web page on all display devices.

The exemplary method 400 further involves applying the color correction filter 204 to display data representing at least a portion of the electronic content 102, as shown in block 440. The viewer application 106 can apply the color correction filter 204 to the display data. For example, if electronic content 102 is a web page with a CSS and display data 202 is a copy of the CSS, a viewer application 106 that is an Internet browser can apply a color correction filter 204 by modifying the color information included in the copy of the CSS according to the correction factors of the color correction filter.

The viewer application 106 can apply the color correction filter by multiplying the color information for each color in the electronic content 102 to be displayed by the correction factor specified by the color correction filter 204. For example, if electronic content 102 was developed using a display device displaying teal as (R=0, G=128, B=128), the viewer application 106 would multiply the RGB values used to display teal in the electronic content by (R: 255/255; G: 255/240; B: 255/240) before providing the display data to a display device 104. A color-corrected version of the display data would therefore specify the color teal using the RGB values (R=0×255/255=0, G=128 255/240=136, B=128×255/240=136).

The exemplary method 400 further involves providing the display data representing a color-corrected version of the electronic content 102 for display by the display device 104, as shown in block 450. The viewer application 106 can provide the display data to the display device 104 via the device driver application 310. The color-corrected version of the electronic content 102 can include, for example, the color information as modified by application of by the color correction filter 204.

For example, display data including a color-corrected version of teal would use the RGB values (R=0, G=136, B=136). The display device 104 distorts the color-corrected version of teal by a factor of (R: 255/255, G: 240/255, B: 240/255). The display device 104 therefore displays teal using the RGB values (R=0×(255/255)×(255/255), G=128×(255/240)×(240/255), B=128×(255/240)×(240/255)), or (R=0, G=128, B=128). "Distorting" the color-corrected RGB values for teal thereby yields the RGB values for teal used by the electronic content 102. The display device 104 can thereby display the electronic content 102 with the appropriate color fidelity.

GENERAL

Numerous specific details are set forth herein to provide a thorough understanding of the claimed subject matter. However, those skilled in the art will understand that the claimed subject matter may be practiced without these specific details. In other instances, methods, apparatuses or systems that would be known by one of ordinary skill have not been described in detail so as not to obscure claimed subject matter.

Some portions are presented in terms of algorithms or symbolic representations of operations on data bits or binary digital signals stored within a computing system memory, such as a computer memory. These algorithmic descriptions or representations are examples of techniques used by those of ordinary skill in the data processing arts to convey the substance of their work to others skilled in the art. An algorithm is a self-consistent sequence of operations or similar processing leading to a desired result. In this context, operations or processing involves physical manipulation of physical quantities. Typically, although not necessarily, such quantities may take the form of electrical or magnetic signals capable of being stored, transferred, combined, compared or otherwise manipulated. It has proven convenient at times, principally for reasons of common usage, to refer to such signals as bits, data, values, elements, symbols, characters, terms, numbers, numerals or the like. It should be understood, however, that all of these and similar terms are to be associated with appropriate physical quantities and are merely convenient labels. Unless specifically stated otherwise, it is appreciated that throughout this specification discussions utilizing terms such as "processing," "computing," "calculating," "determining," and "identifying" or the like refer to actions or processes of a computing device, such as one or more computers or a similar electronic computing device or devices, that manipulate or transform data represented as physical electronic or magnetic quantities within memories, registers, or other information storage devices, transmission devices, or display devices of the computing platform.

The system or systems discussed herein are not limited to any particular hardware architecture or configuration. A computing device can include any suitable arrangement of components that provide a result conditioned on one or more inputs. Suitable computing devices include multipurpose microprocessor-based computer systems accessing stored software that programs or configures the computing system from a general purpose computing apparatus to a specialized computing apparatus implementing one or more embodiments of the present subject matter. Any suitable programming, scripting, or other type of language or combinations of languages may be used to implement the teachings contained herein in software to be used in programming or configuring a computing device.

Embodiments of the methods disclosed herein may be performed in the operation of such computing devices. The order of the blocks presented in the examples above can be varied—for example, blocks can be re-ordered, combined, and/or broken into sub-blocks. Certain blocks or processes can be performed in parallel.

The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Headings, lists, and numbering included herein are for ease of explanation only and are not meant to be limiting.

While the present subject matter has been described in detail with respect to specific embodiments thereof, it will be appreciated that those skilled in the art, upon attaining an understanding of the foregoing, may readily produce alterations to, variations of, and equivalents to such embodiments. Accordingly, it should be understood that the present disclosure has been presented for purposes of example rather than limitation, and does not preclude inclusion of such modifications, variations and/or additions to the present subject matter as would be readily apparent to one of ordinary skill in the art.

What is claimed is:

1. A method comprising:

accessing, by a processor of a computing system, an unfiltered version of electronic content to be displayed on a display device of the computing system;

after accessing the unfiltered version of the electronic content and prior to outputting the unfiltered version of the electronic content via the display device:

automatically selecting, by the processor, a test color from the unfiltered version of the electronic content to be displayed on the display device;

determining, by the processor, color information that is specific to the display device and that is returned in response to a command for the display device to display the test color, the color information comprising intensities of respective primary colors required to display the test color on the display device, generating, by the processor and based on the determined color information, a color correction filter having a correction factor for each of the primary colors, and generating, by the processor, a color-corrected version of the electronic content by applying the color correction filter to the unfiltered version of the electronic content; and providing the color-corrected version of the electronic content to the display device for display.

2. The method of claim 1, wherein generating the color correction filter comprises:

determining a test intensity of each of the primary colors of the test color from the electronic content;

determining a display intensity of each of the primary colors of the color information that is specific to the display device; and determining the correction factor that is a ratio of the test intensity of each primary color of the test color to the display intensity of each primary color of the color information that is specific to the display device.

3. The method of claim 1, wherein applying the color correction filter to the unfiltered version of the electronic content comprises multiplying the color information for each color in the unfiltered version of the electronic content by the correction factor specified by the color correction filter.

4. The method of claim 1, wherein determining the color information that is specific to the display device comprises determining color information used to display a perfect white color in the electronic content.

5. The method of claim 1, wherein determining the color information that is specific to the display device further comprises:

requesting the color information from a device driver application configured to control the display device; and receiving the color information from the device driver application.

6. The method of claim 1, wherein determining the color information that is specific to the display device further comprises:

determining a device type for the display device;

accessing a data file comprising color information for the device type; and retrieving the color information for the device type from the data file.

7. The method of claim 1, wherein the primary colors are red, green, and blue.

8. A computing system comprising:

a processor for executing instructions stored in a computer-readable medium on one or more devices providing a viewer application;

wherein the viewer application comprises one or more modules configured to perform operations comprising:

accessing, by a processor of the computing system, an unfiltered version of electronic content to be displayed on a display device;

after accessing the unfiltered version of the electronic content and prior to outputting the unfiltered version of the electronic content via the display device:

automatically selecting, by the processor of the computing system, a test color from the unfiltered version of the electronic content to be displayed on the display device, determining, by the processor, color information that is specific to the display device and that is returned in response to a command for the display device to display the test color, the color information comprising intensities of respective primary colors required to display the test color on the display device, generating, by the processor and based on the determined color information, a color correction filter having a correction factor for each of the primary colors, and generating, by the processor, a color-corrected version of the electronic content by applying the color correction filter to the unfiltered version of the electronic content; and providing the color-corrected version of the electronic content to the display device for display.

9. The computing system of claim 8, wherein generating the color correction filter comprises:

determining a test intensity of each of the primary colors of the test color from the electronic content;

determining a display intensity of each of the primary colors of the color information that is specific to the display device; and determining the correction factor that is a ratio of the test intensity of each primary color of the test color to the display intensity of each primary color of the color information that is specific to the display device.

10. The computing system of claim 8, wherein applying the color correction filter to the unfiltered version of the electronic content comprises multiplying the color information for each color in the unfiltered version of the electronic content by the correction factor specified by the color correction filter.

11. The computing system of claim 8, wherein determining the color information that is specific to the display device comprises determining color information used to display a perfect white color in the electronic content.

12. The computing system of claim 8, wherein determining the color information that is specific to the display device further comprises:

requesting the color information from a device driver application configured to control the display device; and receiving the color information from the device driver application.

13. The computing system of claim 8, wherein determining the color information that is specific to the display device further comprises:

determining a device type for the display device;

accessing a data file comprising color information for the device type; and retrieving the color information for the device type from the data file.

14. The computing system of claim 8, wherein the primary colors are red, green, and blue.

15. A non-transitory computer-readable medium embodying program code of a viewer application executable by a computing system, the non-transitory computer-readable medium comprising:

program code for accessing, by a processor of the computing system, an unfiltered version of electronic content to be displayed on a display device;

program code for, after accessing the unfiltered version of the electronic content and prior to outputting the unfiltered version of the electronic content via the display device:

automatically selecting, by the processor, a test color from the unfiltered version of the electronic content to be displayed on the display device, determining, by the processor, color information that is specific to the display device and that is returned in response to a command for the display device to display the test color, the color information comprising intensities of respective primary colors required to display the test color on the display device, generating, by the processor and based on the determined color information, a color correction filter having a correction factor for each of the primary colors, and generating, by the processor, a color-corrected version of the electronic content by applying the color correction filter to the unfiltered version of the electronic content; and program code for providing the color-corrected version of the electronic content to the display device for display, wherein the operations of accessing the unfiltered version of the electronic content, selecting the test color, determining color information that is specific to the display device, generating the color correction filter, generating the color-corrected version of the electronic content, and providing the color-corrected version of the electronic content are performed locally at the computing system including the processor and the display device and are performed in response to the viewer application accessing the electronic content.

16. The non-transitory computer-readable medium of claim 15, wherein generating the color correction filter comprises:

program code for determining a test intensity of each of the primary colors of the test color from the electronic content;

program code for determining a display intensity of each of the primary colors of the color information that is specific to the display device; and program code for determining the correction factor that is a ratio of the test intensity of each primary color of the test color to the display intensity of each primary color of the color information that is specific to the display device.

17. The non-transitory computer-readable medium of claim 15, wherein applying the color correction filter to the unfiltered version of the electronic content comprises multiplying the color information for each color in the unfiltered version of the electronic content by the correction factor specified by the color correction filter.

18. The non-transitory computer-readable medium of claim 15, wherein determining the color information that is specific to the display device comprises determining color information used to display a perfect white color in the electronic content.

19. The non-transitory computer-readable medium of claim 15, wherein determining the color information that is specific to the display device further comprises:

requesting the color information from a device driver application configured to control the display device; and receiving the color information from the device driver application.

20. The non-transitory computer-readable medium of claim 15, wherein the primary colors are red, green, and blue.

* * * * *